US006480160B1

(12) United States Patent
Bjornholt et al.

(10) Patent No.: US 6,480,160 B1
(45) Date of Patent: Nov. 12, 2002

(54) RADAR APPARATUS INCLUDING A WAVE GUIDE ARRAY AND A DIELECTRIC LENS

(75) Inventors: John E. Bjornholt, Fountain Hills, AZ (US); Terry B. Wilson, Chandler, AZ (US); Gary M. Hamman, Scottsdale, AZ (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 09/973,582

(22) Filed: Oct. 9, 2001

(51) Int. Cl.[7] ..... H01Q 19/06

(52) U.S. Cl. ..... 343/754; 342/70; 342/71; 343/770; 343/767; 343/757; 343/753; 343/755

(58) Field of Search ..... 342/70–72, 158, 342/175; 343/770, 767, 757, 753, 754, 755

(56) References Cited

U.S. PATENT DOCUMENTS 4,187,507 A * 2/1980 Crane et al. ..... 342/1
5,311,200 A * 5/1994 Walker et al. ..... 342/1
6,097,348 A * 8/2000 Chen et al. ..... 343/775
6,172,648 B1 * 1/2001 Tanizaki et al. ..... 342/1

* cited by examiner

*Primary Examiner*—Thomas H. Tarcza
*Assistant Examiner*—Isam Alsomiri
(74) *Attorney, Agent, or Firm*—Rader, Fishman & Grauer PLLC

(57) ABSTRACT

A radar apparatus has an inclined slot wave guide array to form a narrow azimuth beam and a dielectric lens in front of the array to form a narrow elevation beam. The radar apparatus is particularly useful for motor vehicular collision warning systems. The inclined slot wave guide forms an antenna which is driven to oscillate back and forth at a small angle. The dielectric lens is fixed in position relative to the slotted wave guide antenna. The combination of the slotted array for forming a narrow horizontal pattern in combination with the dielectric lens for forming a vertical pattern provides an arrangement that is readily scannable.

6 Claims, 3 Drawing Sheets

RADAR APPARATUS INCLUDING A WAVE GUIDE ARRAY AND A DIELECTRIC LENS

BACKGROUND OF THE INVENTION

This invention relates to a radar apparatus with an inclined slot wave guide array to form a narrow azimuth beam and a dielectric lens in front of the array to form a narrow elevation beam.

The present construction is directed towards a motor vehicular collision warning system which includes a scanned beam sensor, a signal processor, and a vehicle interface system that initiates warnings to the driver or adaptively controls the vehicle. In this forward looking collision warning system, the sensor is designed to project a narrow beam of energy toward objects in the forward field of view. A forward collision warning control of this type for a vehicle can require a unit life in excess of two hundred million cycles at extreme temperatures. Thus, reliability requirements are high and unit costs must be low.

It is known that transfer slots in the narrow wall of a rectangular wave guide do not normally radiate when energy is propagated through the wave guide. In order to obtain radiation from a transfer slot in the narrow wall of a rectangular wave guide, it is necessary to incline the slot from the transverse position so that a component of the current is transversed to the narrow dimension of the slot. For an environment such as a motor vehicular collision warning system, the dimensions of a rectangular wave guide for a millimeter wave band are quite small. Thus, a problem is presented in using a narrow wall wave guide with inclined slots in a compact area such as exists in a motor vehicular collision warning system.

Since an antenna for a vehicle collision warning system must be small and lightweight to simplify the scanning mechanism, several known antenna constructions are not suitable, including reflector type antennas with fixed or moving feeds, planar wave guide arrays, and microstrip or stripline arrays. Further, the antenna should not be resonant so that its tuning is not critical or frequency sensitive. Moreover, the transmission losses in the antenna should be minimized.

Another issue with respect to any antenna for a vehicular collision avoidance system is whether the antenna can provide a beam suitable for processing. A collision warning system for a vehicle requires that the antenna be capable of millions of cycles at extreme temperature ranges. Thus, to provide an antenna that is compact and readily scannable with low transmission losses is a substantial challenge.

Therefore, it is an object of the present invention to provide a non-resonant, compact, and low loss antenna structure for use with a vehicular collision warning system.

SUMMARY OF THE INVENTION

In accordance with this invention, a radar apparatus is provided with a rotatable antenna structure such as a slotted wave guide antenna. The antenna is driven to oscillate back and forth at a small angle. A transceiver is coupled to the antenna and the antenna passes transmitted and reflected radar signals to and from a target as it is oscillated back and forth. The scanned signals are directed to a processor and then to a vehicle interface system for initiating warnings to the driver or adaptively controlling the vehicle.

The rotatable antenna is mounted to a tuned mass and spring scanner assembly which is designed to produce a controlled harmonic oscillation at a specific resonance frequency when excited by a chain of timed electrical impulses. The impulse timing, duration and amplitude are based upon feedback provided by a position sensor on the scanner.

The antenna of the present invention includes a narrow wall, inclined slot wave guide array for forming a narrow azimuth (horizontal) beam. A dielectric lens is placed in front of the array to form a narrow elevation (vertical) beam. The line array of the antenna is non-resonant. Further, the combination of the inclined slot wave guide array and dielectric lens allows for the formation of horizontal and vertical patterns which may be readily scannable. Moreover, the arrangement is compact and has minimal transmission losses.

The antenna and lens arrangement is used with a millimeter wave vehicle collision warning radar system. The antenna rapidly scans the area in front of a vehicle for providing a narrow beam radiation pattern. Since only the small and lightweight wave guide is moved for scanning, it is possible to rapidly scan the antenna beam with a very low power mechanism.

The foregoing and other advantages and features of the invention will be more apparent from the following description when taken in connection with the accompanying drawings.

DETAILED DESCRIPTION OF A PREFERRED EMBODIMENT

Figure 1:
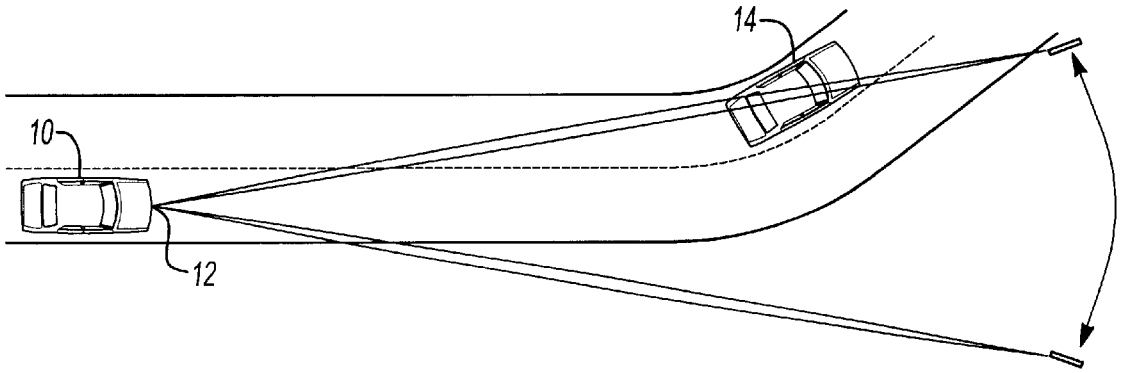
FIG. 1 is an illustration of one embodiment of an environment wherein the present invention may be used.

FIG. 1 illustrates one embodiment of an environment in which the present invention is useful. A traveling vehicle 10 has a vehicular collision warning system 12 mounted at a front portion of the vehicle body. The collision warning system emits a forward signal, such as a radar wave, from the vehicle and also receives a reflected wave from an obstacle, such as another vehicle 14, which is driving towards or away from vehicle 12. The collision warning system measures the distance between the traveling vehicle 10 and the other vehicle 14. If the system detects an object in front of the traveling vehicle, it automatically activates an alarm or adaptively controls the vehicle by, for example, activating a brake to supply a braking force to the vehicle's wheels.

Thus, the vehicular collision warning system notifies the driver of an impending collision or initiates evasive action to avoid a collision or actively adjusts the vehicle speed to maintain a time headway to the closest in path object. Warnings may be visual, auditory, or tactile and the vehicle control actions may include braking, throttle control, transmission control and evasive steering.

Figure 2:
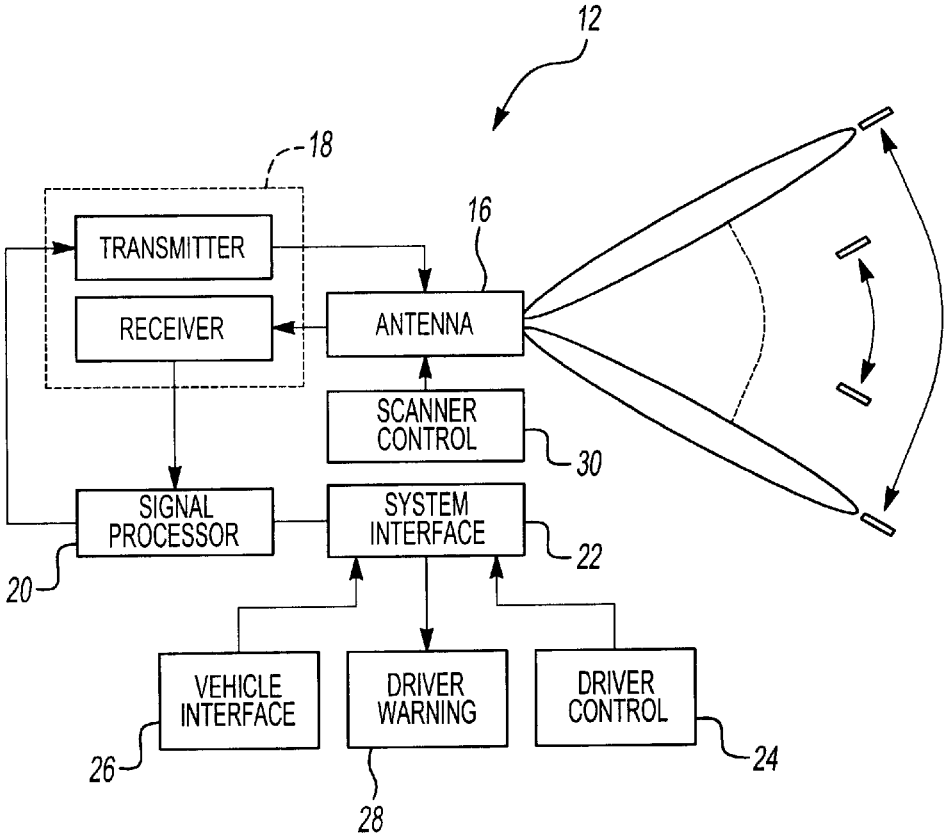
FIG. 2 is a schematic block diagram of a vehicular collision warning system which includes the present invention.

Referring now to FIG. 2, the forward looking collision warning system 12 of the present invention is provided with a rotatable antenna structure 16 which may be in the form of a slotted wave guide antenna. The antenna 16 is driven to oscillate back and forth at a small angle. A transceiver 18 is coupled to the antenna and the antenna passes transmitted and reflected radar signals to and from a target as it is oscillated back and forth. The scanned signals are directed to a processor 20 and then to a system interface 22 which receives input from a driver control 24 and a vehicle interface 26. The outputs from the system interface 22 are directed to a driver warning or adaptive control 28 as well as to the scanner control 30.

Figure 3:
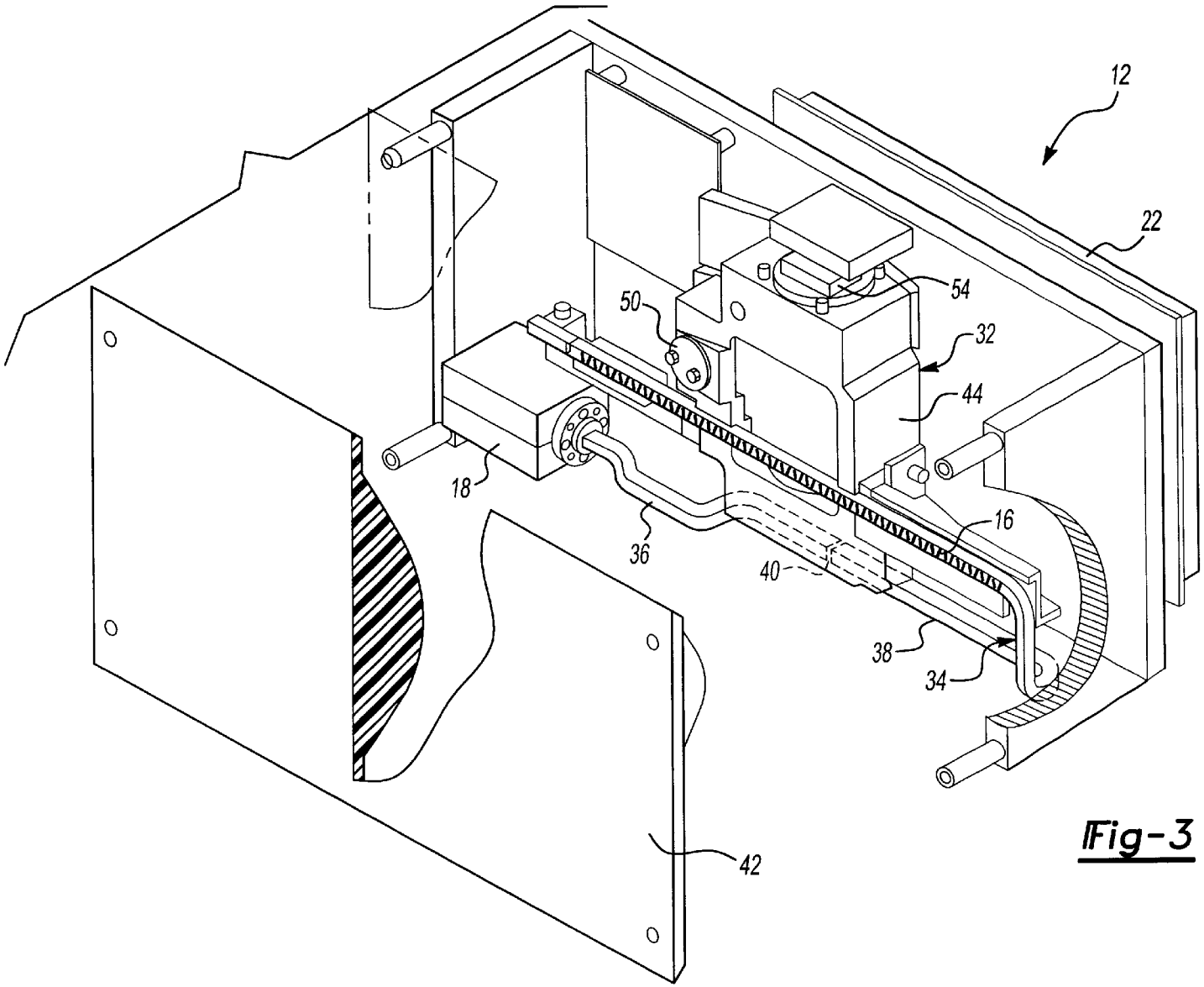
FIG. 3 is a perspective view of one embodiment of a vehicular collision warning system incorporating the teachings of the present invention.

The motor vehicular collision warning system 12 is shown in more detail in FIG. 3. It includes the transceiver 18, an antenna scanner assembly 32, and a rotatable wave guide assembly 34. As will be described in more detail, an antenna portion 16 of the wave guide assembly 34 is driven to oscillate back and forth at a small angle, e.g., 10° in each direction. The transceiver 18 is coupled to the fixed wave guide feed portion 36, and the wave guide assembly passes transmitted and reflected radar signals to and from a target as it is oscillated back and forth. The scanned signals are then directed to the processor 20 and then to a system interface 22 for initiating warnings to the driver or adaptively controlling the vehicle.

The wave guide antenna 16 is rectangular in cross section and includes a feed with a plurality of slotted apertures to pass transmitted and reflected radar signals to and from a target. The angles of inclination of successive slots are predetermined and calculated to give a desired aperture amplitude distribution that determines the radiation pattern. The spacings between the slots are determined to properly phase the energy radiated by the slots.

Another portion 38 of the wave guide is integrally formed with the antenna 16. Wave guide portions 36 and 38 are separated from each other by an air gap 40. The wave guide antenna 16 is mounted to the rotatable scanner assembly 32 such that it may be oscillated back and forth at a small angle. The small air gap 40 allows relative angular movement between the wave guide antenna 16 and the fixed wave guide portion 36.

Figure 5:
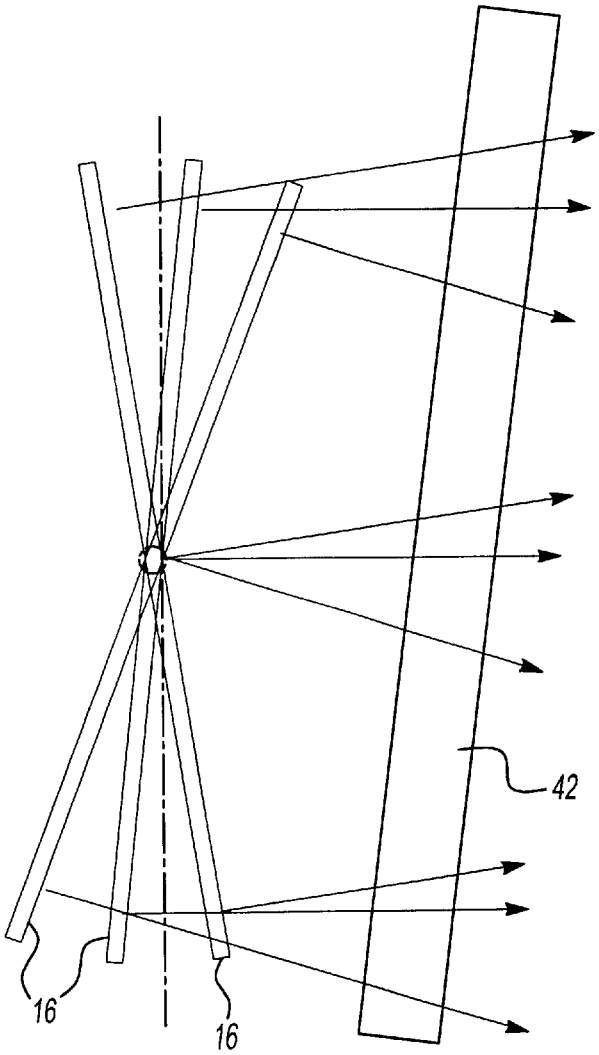
FIG. 5 is a schematic illustration of a rotatable antenna for the radar apparatus wherein the antenna is driven to oscillate for emitting and receiving radar waves.

FIG. 5 schematically illustrates the oscillation of antenna 16. As shown, antenna 16 passes transmitted and reflected radar signals through its slotted apertures to and from a target as it is oscillated back and forth. The signals are passed through a lens 42 which is positioned in front of the oscillating antenna 16. Lens 42 is curved on a single side adjacent to antenna 16 to minimize distortion. As described previously, the scanned signals are directed to a processor and then to a vehicle interface system for initiating warnings to the driver or adaptively controlling the vehicle.

Figure 4:
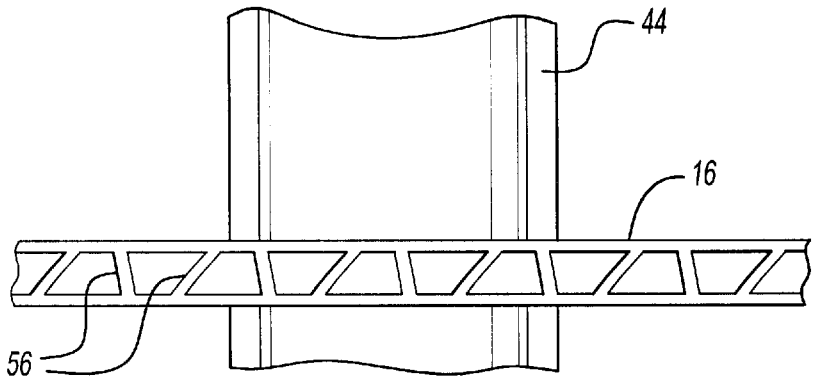
FIG. 4 is a detailed view of the antenna.

Referring now to FIGS. 3–5, the inclined slot wave guide array in antenna 16 forms a narrow azimuth (horizontal) beam. Further, the curved dielectric lens 42 in front of the antenna forms a narrow elevation beam. The combination of the non-resonant line array, such as the narrow wall wave guide 16 with inclined slots, to form the narrow azimuth (horizontal) pattern, in combination with a separate curved dielectric lens to provide the desired elevation (vertical) pattern provides an arrangement that is readily scannable.

The antenna 16 is rapidly scanned in azimuth by angular oscillatory motion of the antenna. As seen in FIG. 4, slots 56 in antenna 16 alternate in inclination such that the odd numbered slots are parallel and inclined in a first direction while the even numbered slots are parallel and inclined in a direction opposite from the odd numbered slots. This positioning of the slots forms a non-resonant array so that tuning for the wave guide is not critical. The low loss dielectric lens 42 focuses the energy in elevation but remains fixed in position. Since only the small and lightweight wave guide 16 is moved for scanning, it is possible to rapidly scan the antenna beam with a very low power mechanism.

Referring again to FIG. 3, the wave guide scanner assembly 32 is an electromechanical mechanism consisting of a moving support 44 with one end mounted by way of a spring flexure device (not shown) to a stationary chassis and another portion mounting the scanning antenna 16. The drive assembly for the moving support is magnetic and has no contacting components. A coil and magnet assembly 50 drive the moving support 44 when positive and negative DC current is applied to the coil which results in oscillating movement of the moving support 44. A position sensor 54 on the scanner assembly 32 provides feedback for determining impulse timing, duration, and amplitude of electrical impulses to the scanner assembly 32.

As will be understood by those of skill in the art, the sensing system of the present invention includes a slotted wave guide antenna and lens combination wherein the slots in the antenna are angled and spaced to form a narrow azimuth pattern and the lens forms a narrow elevation pattern. Even if the antenna did not oscillate (fixed beam), the present construction allows for a concentrated pattern of radio frequency energy to be created.

It is to be understood that the above-described embodiment is merely illustrative of one embodiment of the principles of the present invention. Other embodiments can be devised by those skilled in the art without departing from the scope of the invention.

What is claimed is:

1. A sensing system including:

(a) an oscillating slotted wave guide antenna;

(b) a transceiver coupled to the antenna for transmitting and receiving radar signals as the antenna is oscillated;

(c) a curved dielectric lens positioned adjacent to the antenna; and (d) said slotted wave guide antenna forming a narrow horizontal pattern and said dielectric lens forming a narrow vertical pattern.

2. The sensing system of claim 1 wherein the slots in the antenna are alternatively inclined in opposite directions.

3. The sensing system of claim 2 wherein the antenna is oscillated at a small angle.

4. The sensing system of claim 3 wherein the scanned signals from the antenna are directed to a processor and system for initiating warnings to the driver or adaptively controlling the vehicle.

5. The sensing system of claim 4 wherein the curved dielectric lens is fixed in position and wherein the lens is curved on only a single side that is adjacent to the antenna.

6. A radar sensing system with an inclined slotted wave guide array to form a narrow azimuth pattern and a dielectric lens adjacent to the array to form a narrow elevation pattern wherein the combination of the inclined slotted wave guide array and dielectric lens allows for the formation of concentrated horizontal and vertical patterns for scanning.

* * * * *